US010441039B2

(12) United States Patent
Guzy

(10) Patent No.: US 10,441,039 B2
(45) Date of Patent: Oct. 15, 2019

(54) NECKLACE AND PENDANT ASSEMBLY

(71) Applicant: Joseph Guzy, Mt. Pleasant, PA (US)

(72) Inventor: Joseph Guzy, Mt. Pleasant, PA (US)

( * ) Notice: Subject to any disclaimer, the term of this patent is extended or adjusted under 35 U.S.C. 154(b) by 64 days.

(21) Appl. No.: 15/673,515

(22) Filed: Aug. 10, 2017

(65) Prior Publication Data

US 2019/0045892 A1 Feb. 14, 2019

(51) Int. Cl.

| | |
|---|---|
| ***A44C 15/00*** | (2006.01) |
| ***A44C 25/00*** | (2006.01) |
| *A44C 5/20* | (2006.01) |

(52) U.S. Cl.

CPC ..... *A44C 15/005* (2013.01); *A44C 25/001* (2013.01); *A44C 5/209* (2013.01)

(58) Field of Classification Search

CPC ..... A44C 25/007; A44C 11/00; A44C 15/005
USPC ..... 63/40, 1.18, 38
See application file for complete search history.

(56) References Cited

U.S. PATENT DOCUMENTS

| | | | | |
|---|---|---|---|---|
| 8,882,286 | B1 | 11/2014 | Delgado Antunez | |
| 2001/0045033 | A1 | 11/2001 | Fischer | |
| 2003/0136149 | A1* | 7/2003 | Logan | A44C 11/002 63/35 |
| 2008/0053146 | A1 | 3/2008 | Burress | |
| 2008/0245103 | A1* | 10/2008 | Evans | A44C 15/003 63/1.11 |
| 2014/0223961 | A1 | 8/2014 | Mullins | |
| 2015/0143700 | A1 | 5/2015 | Stebing | |
| 2016/0316863 | A1 | 11/2016 | Mancini | |

OTHER PUBLICATIONS

AZsupplies, 5 Silver Tube Antique Silver Plated Brass Spacer Bead G13674, Dec. 10, 2018, Etsy, p. 1 (Year: 2018).*
AZsupplies, Reviews, Nov. 8, 2013, Etsy, p. 5 (Year: 2013).*

* cited by examiner

*Primary Examiner* — Abigail E Troy

(57) ABSTRACT

A necklace and pendant assembly for indicating a relationship status of a user includes a necklace that may be worn. A plurality of pendants is provided and each of the pendants has a unique color with respect to each other. Each of the pendants communicates a relationship status of the user with respect to being single, in a relationship and being married. A selected one of the pendants is positioned on the necklace. In this way the selected pendant communicates the relationship status of the user.

5 Claims, 2 Drawing Sheets

NECKLACE AND PENDANT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to pendant devices and more particularly pertains to a new pendant device for indicating a relationship status of a user.

BRIEF SUMMARY OF THE INVENTION

An embodiment of the disclosure meets the needs presented above by generally comprising a necklace that may be worn. A plurality of pendants is provided and each of the pendants has a unique color with respect to each other. Each of the pendants communicates a relationship status of the user with respect to being single, in a relationship and being married. A selected one of the pendants is positioned on the necklace. In this way the selected pendant communicates the relationship status of the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
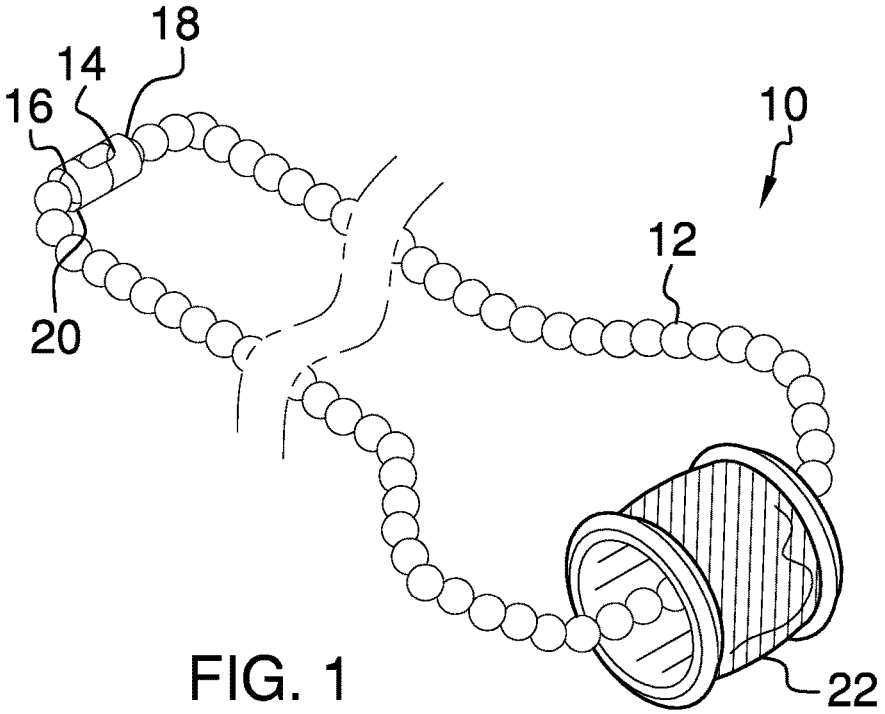
FIG. 1 is a perspective view of a necklace and pendant assembly according to an embodiment of the disclosure.
Figure 2:
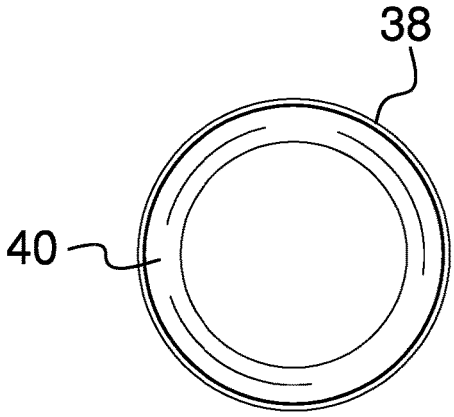
FIG. 2 is a right side view of pendant of an embodiment of the disclosure.
Figure 3:
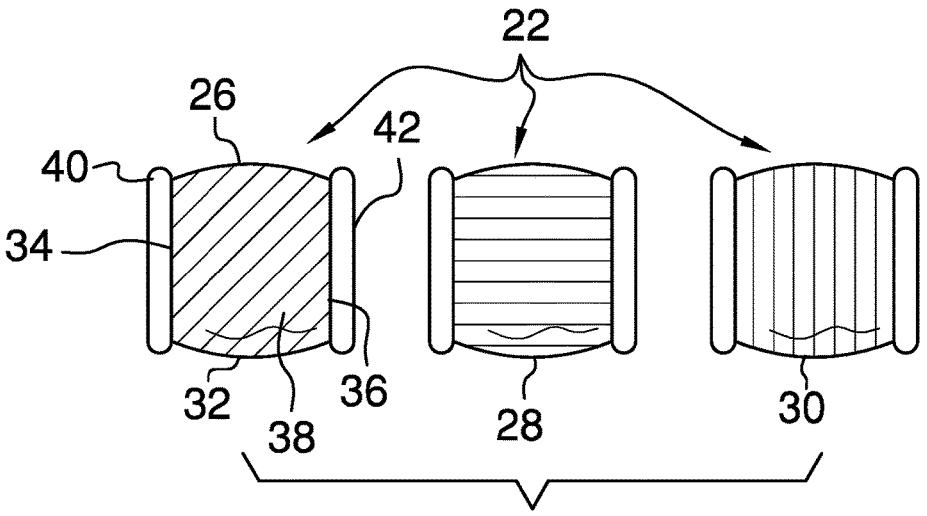
FIG. 3 is a perspective view of a plurality of pendants of an embodiment of the disclosure.
Figure 4:
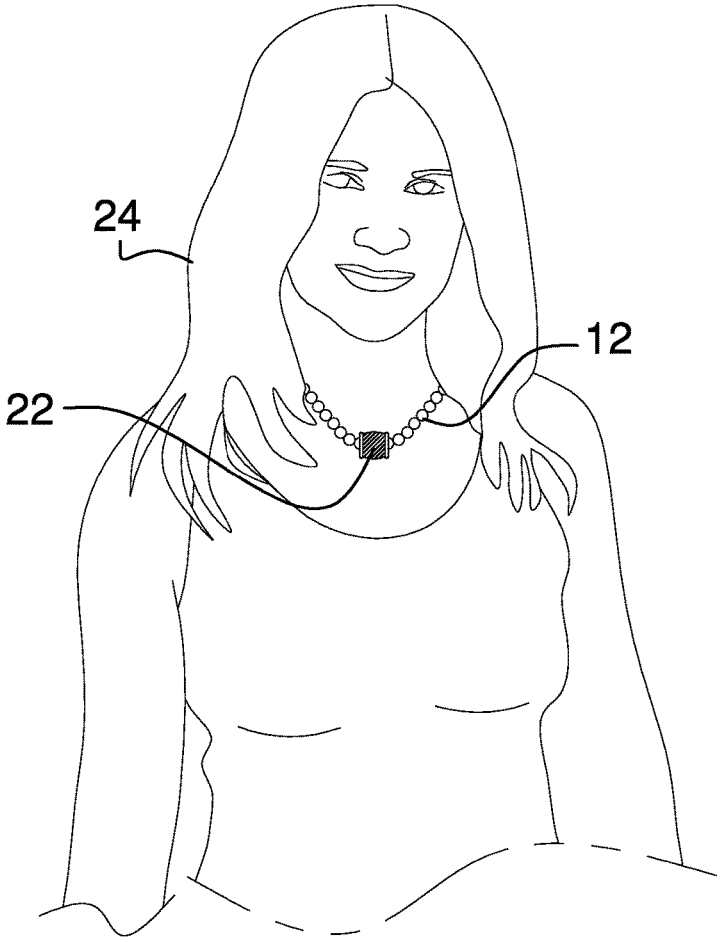
FIG. 4 is a perspective in-use view of an embodiment of the disclosure.

With reference now to the drawings, and in particular to FIGS. 1 through 4 thereof, a new pendant device embodying the principles and concepts of an embodiment of the disclosure and generally designated by the reference numeral 10 will be described.

As best illustrated in FIGS. 1 through 4, the necklace and pendant assembly 10 generally comprises a necklace 12 that may be worn. The necklace 12 has a first end 14 and a second end 16 and the necklace 12 may comprise a string of pearls or the like. A first coupler 18 is coupled to the first end 14 of the necklace 12 and a second coupler 20 is coupled to the second end 16 of the necklace 12. The first coupler 18 is matable to the second coupler 20 such that the necklace 12 forms a closed loop. Each of the first 18 and second 20 couplers may be mechanical necklace 12 fasteners of any conventional design.

A plurality of pendants 22 is provided and each of the pendants 22 has a unique color with respect to each other. Thus, each of the pendants 22 may communicate a relationship status of a user 24 with respect to being single, in a relationship and being married. A selected one of the pendants 22 is positioned on the necklace 12 to communicate the relationship status of the user 24. The plurality of pendants 22 includes a first pendant 26, a second pendant 28 and a third pendant 30. The first pendant 26 may have a green color to indicate the user 24 is single. The second pendant 28 may have a blue color to indicate the user 24 is in a relationship. The third pendant 30 may have a red color to indicate the user 24 is married.

Each of the pendants 22 comprised a cylinder 32 that has a first end 34, a second end 36 and an outer wall 38 extending therebetween. The cylinder 32 is substantially hollow and each of the first end 14 and the second end 16 of the cylinder 32 is open. The necklace 12 is extended through the first 14 and second 16 ends such that the cylinder 32 is retained on the necklace 12. The cylinder 32 corresponding to each of the pendants 22 has the unique color with respect to each other. A first ring 40 is coupled around the outer wall 38 of the cylinder 32 and the first ring 40 is aligned with the first end 34 of the cylinder 32. A second ring 42 is coupled around the outer wall 38 of the cylinder 32 and the second ring 42 is aligned with the second end 36 of the cylinder 32.

In use, the necklace 12 is extended through the first pendant 26 and the necklace 12 is worn to communicate that the user 24 is single. In this way the user 24 communicates to other people that the user 24 is available for dating or other forms of personal relationships. The necklace 12 is extended through the second pendant 28 and the necklace 12 is worn to communicate that that user 24 is in a relationship. In this way the user 24 communicates to other people that the user 24 is not available for dating or other forms of personal relationships. The necklace 12 is extended through the third pendant 30 and the necklace 12 is worn to communicate that the user 24 is married. In this way the user 24 communicates to other people that the user 24 is not available for dating and other forms of personal relationships.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A necklace and pendant assembly being configured to be worn thereby facilitating said assembly to communicate a relationship status of a user, said assembly comprising:

a necklace having a plurality of beads, said necklace being configured to be worn; and a plurality of pendants, each of said pendants having a unique color with respect to each other wherein each of said pendants is configured to communicate a relationship status of the user with respect to being single, in a relationship and being married, a selected one of said pendants being positioned on said necklace wherein said selected pendant is configured to communicate the relationship status of the user, each of said pendants comprising a cylinder having a first end, a second end and an outer wall extending therebetween, said outer wall displaying said unique color, each of said first end and said second end being open, said necklace being extended through said first and second ends such that said cylinder is retained on said necklace, said cylinder being substantially hollow and having an interior diameter greater than an outer diameter of said beads of said necklace such that each said pendant slides freely over said beads of said necklace wherein each said pendant is gravitationally drawn to a lowest point of said necklace while said necklace is being worn.

2. The assembly according to claim 1, further comprising:

said necklace having a first end and a second end;

a first coupler being coupled to said first end of said necklace; and a second coupler being coupled to said second end of said necklace, said first coupler being matable to said second coupler such that said necklace forms a closed loop.

3. The assembly according to claim 1, further comprising a first ring being coupled around said outer wall of said cylinder, said first ring being aligned with said first end.

4. The assembly according to claim 1, further comprising a second ring being coupled around said outer wall of said cylinder, said second ring being aligned with said second end.

5. A necklace and pendant assembly being configured to be worn thereby facilitating said assembly to communicate a relationship status of a user, said assembly comprising:

a necklace being configured to be worn, said necklace having a first end, a second end, and a plurality of beads between the first end and the second end;

a first coupler being coupled to said first end of said necklace;

a second coupler being coupled to said second end of said necklace, said first coupler being matable to said second coupler such that said necklace forms a closed loop; and a plurality of pendants, each of said pendants having a unique color with respect to each other wherein each of said pendants is configured to communicate a relationship status of the user with respect to being single, in a relationship and being married, a selected one of said pendants being positioned on said necklace wherein said selected pendant is configured to communicate the relationship status of the user, each of said pendants comprising:

a cylinder having a first end, a second end and an outer wall extending therebetween, said cylinder being substantially hollow, said outer wall displaying said unique color, each of said first end and said second end being open, said necklace being extended through said first and second ends such that said cylinder is retained on said necklace, said cylinder being substantially hollow and having an interior diameter greater than an outer diameter of said beads of said necklace such that each said pendant slides freely over said beads of said necklace wherein each said pendant is gravitationally drawn to a lowest point of said necklace while said necklace is being worn, a first ring being coupled around said outer wall of said cylinder, said first ring being aligned with said first end, and a second ring being coupled around said outer wall of said cylinder, said second ring being aligned with said second end.

* * * * *